US007063440B2

(12) United States Patent
Mohacsi et al.

(10) Patent No.: US 7,063,440 B2
(45) Date of Patent: Jun. 20, 2006

(54) LED ACCENT LIGHTING UNITS

(75) Inventors: Ferenc Mohacsi, Muskego, WI (US); Melissa Mueller Kwaterski, Wauwatosa, WI (US); Michael Plichta, Oconomowoc, WI (US)

(73) Assignee: Everbrite, LLC, Greenfield, WI (US)

( * ) Notice: Subject to any disclaimer, the term of this patent is extended or adjusted under 35 U.S.C. 154(b) by 0 days.

(21) Appl. No.: 10/447,311

(22) Filed: May 28, 2003

(65) Prior Publication Data

US 2003/0223235 A1 Dec. 4, 2003

Related U.S. Application Data

(60) Provisional application No. 60/385,025, filed on Jun. 3, 2002.

(51) Int. Cl.
*F21V 1/00* (2006.01)
*F21V 7/00* (2006.01)
*F21V 7/10* (2006.01)

(52) U.S. Cl. ..... 362/240; 362/238; 362/243

(58) Field of Classification Search ..... 362/240, 362/238, 243, 800, 241, 244, 245, 246, 247, 362/227, 248, 249, 250, 252, 234; 439/419, 439/505

See application file for complete search history.

(56) References Cited

U.S. PATENT DOCUMENTS

| | | | | |
|---|---|---|---|---|
| 4,173,035 A | | 10/1979 | Hoyt | 362/249 |
| 4,203,646 A | | 5/1980 | Desso et al. | 439/724 |
| 4,254,453 A | * | 3/1981 | Mouyard et al. | 362/240 |
| 4,521,839 A | | 6/1985 | Cook et al. | 362/238 |
| 4,628,421 A | * | 12/1986 | Saar | 362/238 |
| 4,631,648 A | | 12/1986 | Nilssen | 362/150 |
| 4,712,165 A | | 12/1987 | Celtrone | 362/147 |
| 4,878,862 A | | 11/1989 | Wise | 439/787 |
| 4,884,178 A | | 11/1989 | Roberts | 362/241 |
| 4,938,701 A | | 7/1990 | Heberling | 439/65 |
| 5,099,401 A | | 3/1992 | Kondo et al. | 362/541 |
| 5,107,408 A | | 4/1992 | Vernondier | 362/238 |
| 5,410,453 A | | 4/1995 | Ruskouski | 362/20 |
| 5,490,049 A | | 2/1996 | Montalan et al. | 362/240 |
| 5,506,760 A | * | 4/1996 | Giebler et al. | 362/249 |
| 5,580,156 A | | 12/1996 | Suzuki et al. | 362/184 |
| 5,655,830 A | | 8/1997 | Ruskouski | 362/240 |
| 5,854,542 A | * | 12/1998 | Forbes | 315/291 |

(Continued)

FOREIGN PATENT DOCUMENTS

EP 0 911 573 4/1999

(Continued)

OTHER PUBLICATIONS

Ryan Wellman, "SnapLED Design Guidelines," from the website of Lumileds Lighting Company LLC: www.lumileds.com/products/list/snap.htm, printed on Sep. 11, 2003.

(Continued)

*Primary Examiner*—Ali Alavi
*Assistant Examiner*—Bao Q. Truong
(74) *Attorney, Agent, or Firm*—Michael Best & Friedrich, LLP

(57) ABSTRACT

A lighting unit including at least one elongated substrate having a plurality of light-emitting optoelectronic devices mounted thereon and an elongated housing supporting the elongated substrate. The housing includes integrally-formed reflectors positioned adjacent the optoelectronic devices. The lighting unit also includes a translucent output panel that transmits light from the optoelectronic devices. The light unit has a first wiring harness for connection to a power source, and a second wiring harness connectable to an adjacent lighting unit.

51 Claims, 6 Drawing Sheets

U.S. PATENT DOCUMENTS

| | | | | |
|---|---|---|---|---|
| 5,924,785 | A | 7/1999 | Zhang et al. | 362/241 |
| 6,019,486 | A | 2/2000 | Stewart, Jr. | 362/362 |
| 6,074,074 | A | 6/2000 | Marcus | 362/240 |
| 6,076,936 | A | 6/2000 | George | 362/146 |
| 6,095,663 | A | 8/2000 | Pond et al. | 362/247 |
| 6,113,248 | A | 9/2000 | Mistopoulos et al. | 362/240 |
| 6,260,981 | B1 | 7/2001 | Fiene | |
| 6,283,612 | B1 * | 9/2001 | Hunter | 362/240 |
| 6,367,949 | B1 | 4/2002 | Pederson | |
| 6,406,166 | B1 | 6/2002 | Ko | 362/249 |
| 6,461,008 | B1 | 10/2002 | Pederson | |
| 6,476,726 | B1 | 11/2002 | Pederson | |
| 6,491,412 | B1 * | 12/2002 | Bowman et al. | 362/249 |
| 6,511,187 | B1 | 1/2003 | Hunter | 362/250 |
| 6,623,151 | B1 | 9/2003 | Pederson | |
| 6,707,389 | B1 | 3/2004 | Pederson | |
| 2002/0071268 | A1 | 6/2002 | Pederson | |
| 2002/0093820 | A1 | 7/2002 | Pederson | |
| 2003/0021121 | A1 | 1/2003 | Pederson | |
| 2003/0048641 | A1 | 3/2003 | Alexanderson et al. | 362/470 |
| 2004/0032745 | A1 | 2/2004 | Pederson | |

FOREIGN PATENT DOCUMENTS

| | | |
|---|---|---|
| WO | WO 00/31463 | 6/2000 |
| WO | WO 01/10674 | 2/2001 |
| WO | WO 01/10675 | 2/2001 |
| WO | WO 01/10676 | 2/2001 |
| WO | WO 2004/015326 | 2/2004 |

OTHER PUBLICATIONS

Connectors manufactured by Lumileds Lighting Company LLC that are configured to physically and electrically connect adjacent substrates, the connectors being commercially available at least as early as Apr. of 2000 (see attached statement of relevance and FIGS. 1-3).

* cited by examiner

LED ACCENT LIGHTING UNITS

RELATED APPLICATIONS

This is a non-provisional patent application of U.S. provisional Patent Application Ser. No. 60/385,025 filed on Jun. 3, 2002, which is incorporated herein by reference.

FIELD OF THE INVENTION

This invention relates generally to lighting fixtures, and more particularly to fixtures that provide accent lighting.

BACKGROUND OF THE INVENTION

In commercial applications, accent lighting is typically used to capture the attention of potential customers. Accent lighting may highlight or supplement a primary display of some sort. Accent lighting may also be used to highlight store information, such as location, hours of operation, a slogan, etc. Accent lighting may also be used to advertise product information like the product name, a slogan related to the product, locations where to find the product, etc.

Commonly, accent lighting includes conventional light sources such as incandescent, fluorescent, or neon lights that provide the desired illumination. However, these light sources can have several drawbacks. Some of these light sources consume large amounts of electricity making them expensive to operate; particularly for outdoor signs that are illuminated for long periods of time. Conventional light sources can also generate a significant amount of heat that is not easily dissipated. In addition, conventional incandescent light sources can have a short life and/or are susceptible to damage when compared to some less conventional light sources, and as such must be inspected and replaced periodically. Neon or fluorescent lights require expensive power supplies, and typically operate at a high voltage.

SUMMARY OF THE INVENTION

The present invention provides a lighting unit including at least one elongated substrate including a plurality of light-emitting optoelectronic devices mounted thereon and an elongated housing supporting the elongated substrate. The housing also includes integrally-formed reflectors positioned adjacent the optoelectronic devices, and a translucent output panel that transmits light from the optoelectronic devices.

The present invention also provides a lighting unit including an elongated substrate having a plurality of optoelectronic devices mounted thereon and a first wiring harness extending from one end of the substrate and terminating with a first connector. The first wiring harness has two wires that electrically connect the plurality of optoelectronic devices with a power source. The lighting unit also includes a second wiring harness that electrically connect to the first wiring harness and the power source. The second wiring harness also has two wires that terminate with a second connector engageable with the first connector. The second wiring harness extends in a cavity or recess in the lighting unit to electrically connect an adjacent substrate or lighting unit module to the power source.

The present invention also provides a lighting unit including an elongated substrate having a plurality of optoelectronic devices mounted thereon, and a first wiring harness extending from one end of the substrate and terminating with a first connector. The first wiring harness electrically connects the plurality of optoelectronic devices with a power source. In one embodiment, the lighting unit also includes a second wiring harness extending from the same end of the substrate as the first wiring harness and terminating with a second connector engageable with the first connector. In another embodiment, the second wiring harness extends from an end of the substrate that is opposite to the end from which the first wiring harness extends. In both embodiments, the second wiring harness is electrically connected with the power source. The second wiring harness preferably extends along in a cavity or recess in the lighting unit to electrically connect an adjacent substrate or lighting unit module to the power source.

Further, the present invention provides a lighting assembly including a first lighting unit having an elongated substrate including a plurality of optoelectronic devices mounted thereon and a first wiring harness having a first connector. The first wiring harness is coupled to one end of the substrate to electrically connect the plurality of optoelectronic devices with a power source. The first lighting unit also has a second wiring harness including a second connector. The first wiring harness has either a male or female connector, and the second wiring harness has the other of the male or female connector. The second wiring harness may be coupled to the same end of the substrate as the first wiring harness to receive power from the power source, and is extendable along the substrate in a cavity of the lighting unit. The lighting assembly also includes a second lighting unit similar to the first lighting unit. The second lighting unit is positioned adjacent the first lighting unit such that the second connector of the first lighting unit engages the first connector of the second lighting unit to electrically connect the second wiring harness of the first lighting unit with the first wiring harness of the second lighting unit.

BRIEF DESCRIPTION OF THE DRAWINGS

In the drawings, wherein like reference numerals indicate like parts.

Figure 1A:
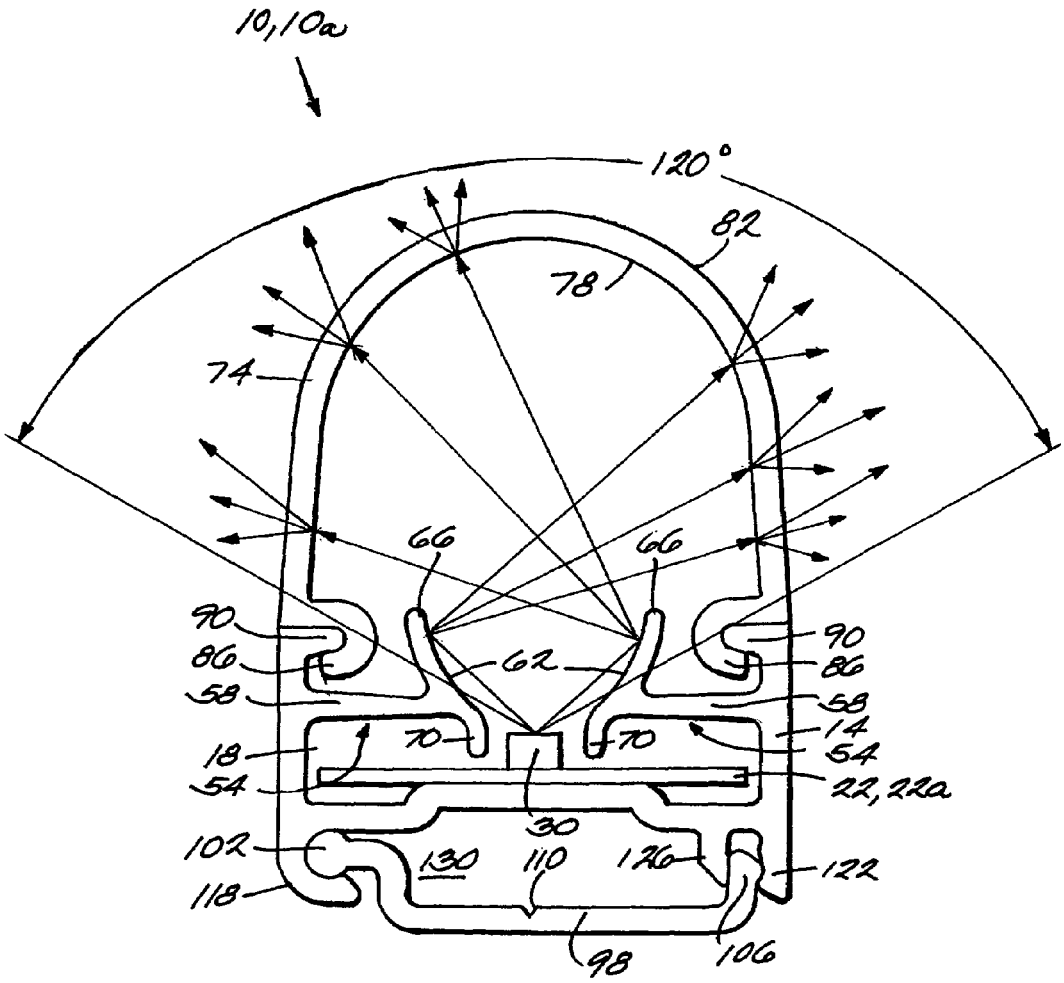
FIG. 1*a* is a cross-sectional view of a LED accent lighting unit embodying the present invention.

Before at least one embodiment of the invention is explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that the phraseology and terminology used herein is for the purpose of description and should not be regarded as limited.

DETAILED DESCRIPTION

FIG. 1*a* illustrates a cross-sectional view of an LED accent lighting unit 10. The unit 10 includes a housing 14 extruded from plastic and cut to a pre-determined length. The housing 14 includes a slot portion 18 to insert and constrain multiple substrates 22 (see FIG. 2*a*). One of the multiple substrates 22 is electrically connected at one end to a power source that provides DC voltage through a wiring harness 26. Typically, either of the substrates 22 positioned at opposite ends of the unit 10 may be electrically connected to the power source via the wiring harness 26. Each substrate 22 includes multiple wide-beam LEDs 30 that emit light over an angle of about 120 degrees. The LEDs 30 are energy efficient and as a result, large amounts of heat need not be dissipated. Each substrate 22 also includes at least one resistor 34 that provides the desired level of DC current to the LEDs 30, which is about 20 mA. The LEDs 30 can thus be configured to operate at a low voltage, typically in the 12 to 60 volt range.

Figure 2B:
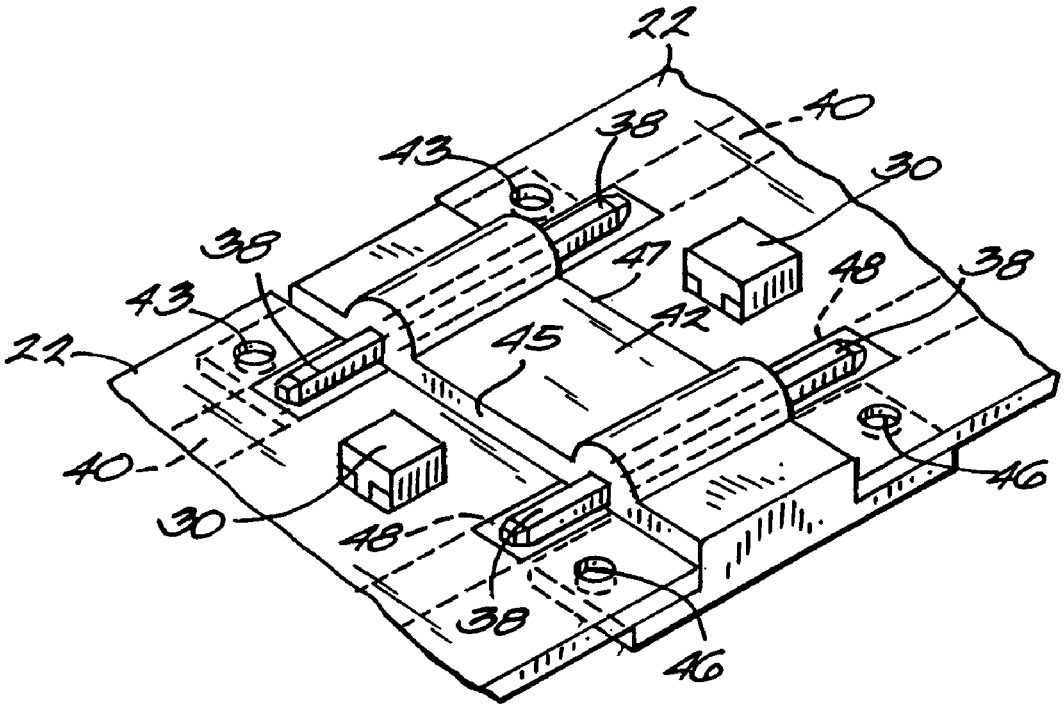
FIG. 2*b* is an enlarged, perspective view of the electrical connector of FIG. 2*a;*
Figure 2A:
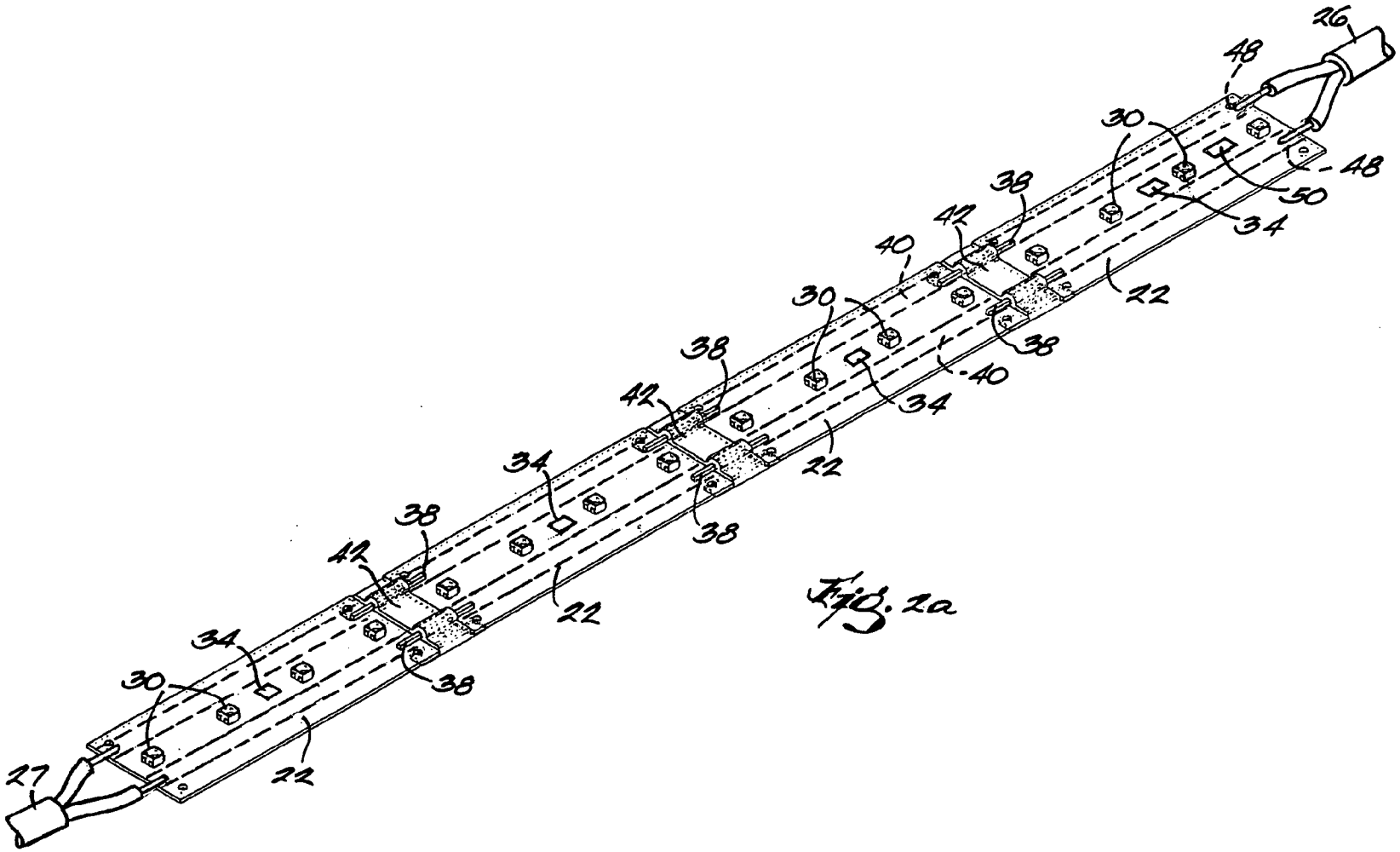
FIG. 2*a* is a perspective view of multiple interconnected substrates, illustrating multiple LEDs on each substrate and insulated electrical connectors interconnecting the substrates.

In one configuration of the substrate 22, as shown in FIG. 2*a*, the resistor 34 is located toward the middle of each substrate 22. Alternatively, the resistor 34 can be positioned toward either end of the substrate 22. Also in the illustrated embodiment, four LEDs 30 are wired in series with the resistor 34. This configuration provides a voltage of about 12–40 (preferably 12–24) VDC to each group of four LEDs 30. Alternatively, more or fewer than four LEDs 30 may be wired in series with the resistor 34.

As shown in FIGS. 2*a* and 2*b*, multiple substrates 22 are electrically connected to the power source by connector pins 38 that are soldered to adjacent substrates 22. The substrates 22 include buses 40 extending along the length of the substrates 22 that electrically connect the LEDs 30 and resistors 34 to the power source when adjacent substrates 22 are electrically connected by the connector pins 38. Insulating clips 42 support and substantially surround the connector pins 38, and provide a mechanical connection between adjacent substrates 22 in addition to insulating the connector pins 38. The clips 42 have nubs 43 that snap into existing apertures 46 located on the adjacent substrates 22 to interlock the adjacent substrates 22. The clips 42 also have ramped or chamfered surfaces 45 and 47, particularly in the region between pins 38, to avoid interference with the LED wires and thereby aid in assembly to substrates 22.

Upon interlocking two adjacent substrates 22 with an insulating clip 42 having the connector pins 38, the connector pins 38 come into electrical and physical contact with contact plates 48, which are exposed portions of the buses 40. As a result, the substrate 22 that is directly electrically connected with the power source provides power to other interconnected substrates via the electrical contact between the buses 40 and the connector pins 38. Also, the connector pins 38 may include chamfered ends to aid in the interconnection of two adjacent substrates 22.

In the embodiment depicted in FIG. 2*a*, the substrates 22 are not designed to be cuttable, unlike the substrates 22*a* discussed below in connection with the second embodiment. As a result, a lighting unit comprising of several substrates 22 preferably has a first wiring harness 26 disposed at one end of the lighting unit, and a second wiring harness 27 disposed at an opposite end of the lighting unit. The first wiring harness 26 has a connector that is either a male or female connector like either connector 140 or 144 (FIG. 4*b*). The second wiring harness will have a connector that is the other of a male or female connector like either connector 144 or 140. Both wiring harnesses are connected to bus 40. The first wiring harness of the end lighting unit in the assembly is connected to a power source. The second wiring harness of that same lighting unit is connected to the first wiring harness of an adjacent lighting unit in the assembly. In this way, a lighting assembly comprising multiple lighting units or modules may receive power from the power source via the bus and their respective first and second wiring harnesses.

Another configuration of the substrates, indicated by reference numeral 22*a*, is partially illustrated in FIG. 4*b* being utilized in lighting units 10*a*. The substrates 22*a* are substantially similar to the substrates 22 of FIG. 2*a*, with like components having like reference numerals. Each substrate 22*a* is divided into multiple sections 49, with each section 49 including two LEDs 30 wired in series with a resistor 34. Each substrate 22*a* is cuttable, such that any number of sections 49 may be cut from the substrate 22*a* to shorten the substrate 22*a*. This allows a user to custom-fit the substrate 22*a* to a user-specific application.

In each lighting unit 10*a*, multiple substrates 22*a* may be interconnected using the same connector pins and clips (not shown in FIG. 4*b*) as the substrates 22 of FIG. 2*a*, and power may be transferred to interconnected substrates via the buses 40 and connector pins. One of the multiple substrates 22*a* in each lighting unit 10*a* is directly electrically connected to the power source by a first wiring harness 26*a*. The first wiring harness 26*a* includes two wires that are soldered or otherwise connected to the contact plates 48 of the buses 40 at one end of the substrate 22*a* to provide power to all the interconnected substrates 22*a*. The first wiring harness 26*a* connects to the power source via an input connector 140 having a first configuration. The substrate 22*a* having the first wiring harness 26*a* also includes a second wiring harness 26*b* having two wires soldered or otherwise connected to the same contact plates 48 as the wires of the first wiring harness 26*a*. The second wiring harness 26*b* includes an output connector 144. This is either a male or female connector engageable with the first connector 140. The length of the second wiring harness 26*b* allows the second wiring harness 26*b* to extend along the multiple interconnected substrates 22*a* and away from the end of the substrate 22*a* connected to the second wiring harness 26*b*, in cavity 130 (FIG. 1*a*).

At least one transient suppressor 50 is included in the units 10, 10*a* and electrically connected to one of the substrates 22, 22*a* within the units 10, 10*a*. The transient suppressor 50 substantially prevents voltage spikes from damaging the LEDs 30 due to static electricity resulting from handling and other situations. As shown in FIGS. 2*a* and 4*b*, the transient suppressor 50 is shown toward the end of the substrate 22, 22*a* connected to the power source. Alternatively, the transient suppressor 50 can be located anywhere on any of the substrates 22, 22*a*.

The substrates 22, 22*a* are also coated by a flexible waterproof transparent sealer for protection against the outside environment. The sealer protects the substrates 22, 22*a* and the LEDs 30 from the environment, while allowing the substrates 22, 22*a* to expand and contract with varying temperatures.

Since the substrates 22, 22*a* are also made of a fiberglass material and are relatively thin, the substrates 22, 22*a* include some degree of flexibility. This allows the substrates 22, 22*a* to be used in applications demanding the substrates 22, 22*a* to bend around some curved surfaces.

Figure 1B:
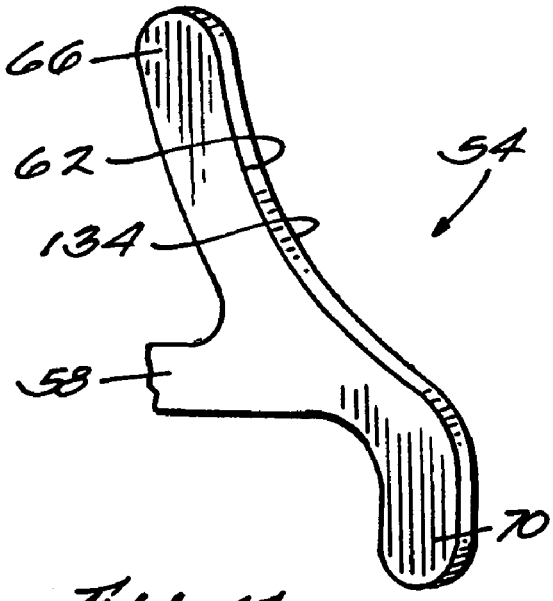
FIG. 1*b* is an enlarged, cross-sectional view of an integrally-formed reflector of the LED accent lighting unit of FIG. 1*a;*
Figure 3:
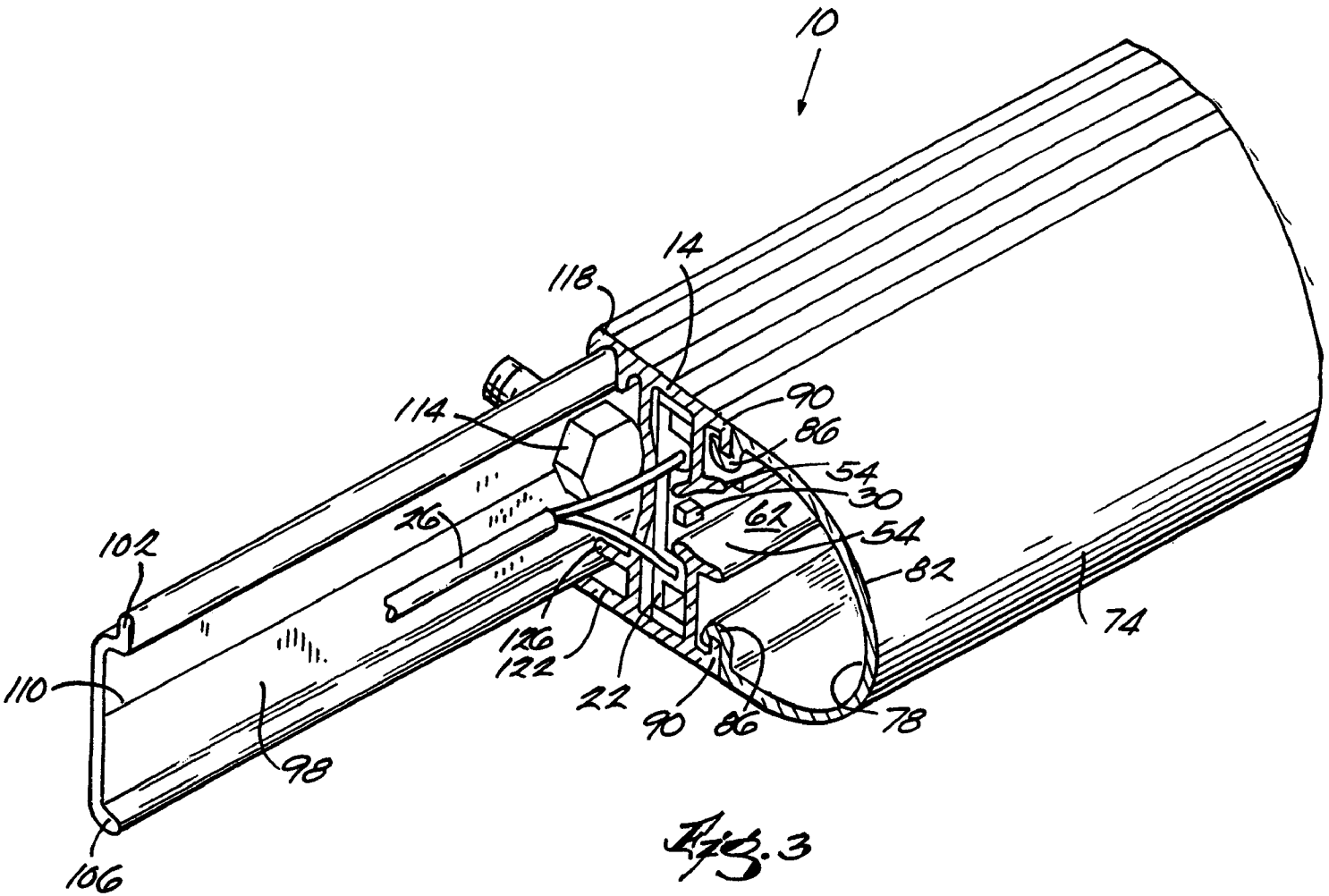
FIG. 3 is a perspective view of the LED accent lighting unit of FIG. 1*a*, illustrating a housing attached to a mounting strip.

As shown in FIGS. 1*a* and 3, the housing 14 includes integrally-formed reflectors 54. The reflectors 54 define the upper part of the slot portion 18 and help constrain the substrates 22, 22*a* within the slot portion 18. The reflectors 54 include stems 58 projecting from opposing sides of the housing 14 that are integrally formed with opposing reflective surfaces 62. Each reflective surface 62 includes a curved portion 66 and a straight portion 70 (most clearly shown in FIG. 1*b*). The LEDs 30 are positioned at substantially the same level as the straight portion 70 such that the light emitted by the LEDs 30 is substantially incident on the reflective surfaces 62 above the straight portion 70. The curved portion 66 is positioned above the straight portion 70 and reflects the light emitted by the LEDs 30. The reflective surfaces 62 additionally diffuse the incident light.

As shown in FIG. 1*a*, a lens 74 including an inner surface 78 and outer surface 82 is positioned above the LEDs 30 and connected to the housing 14 via a hook and slot arrangement. The hooks 86 are integrally formed with the lens 74 of an impact-resistant acrylic. The slots 90 are integrally formed with the housing 14 and engage the hooks 86 to interconnect the lens 74 and housing 14. The lens 74 is translucent and also acts as a diffuser for the light incident on the inner surface 78 so that the light transmitted from the outer surface 82 is diffused. As a result, a substantially uniform light is emitted from the outer surface 82 of the lens 74.

Figure 4A:
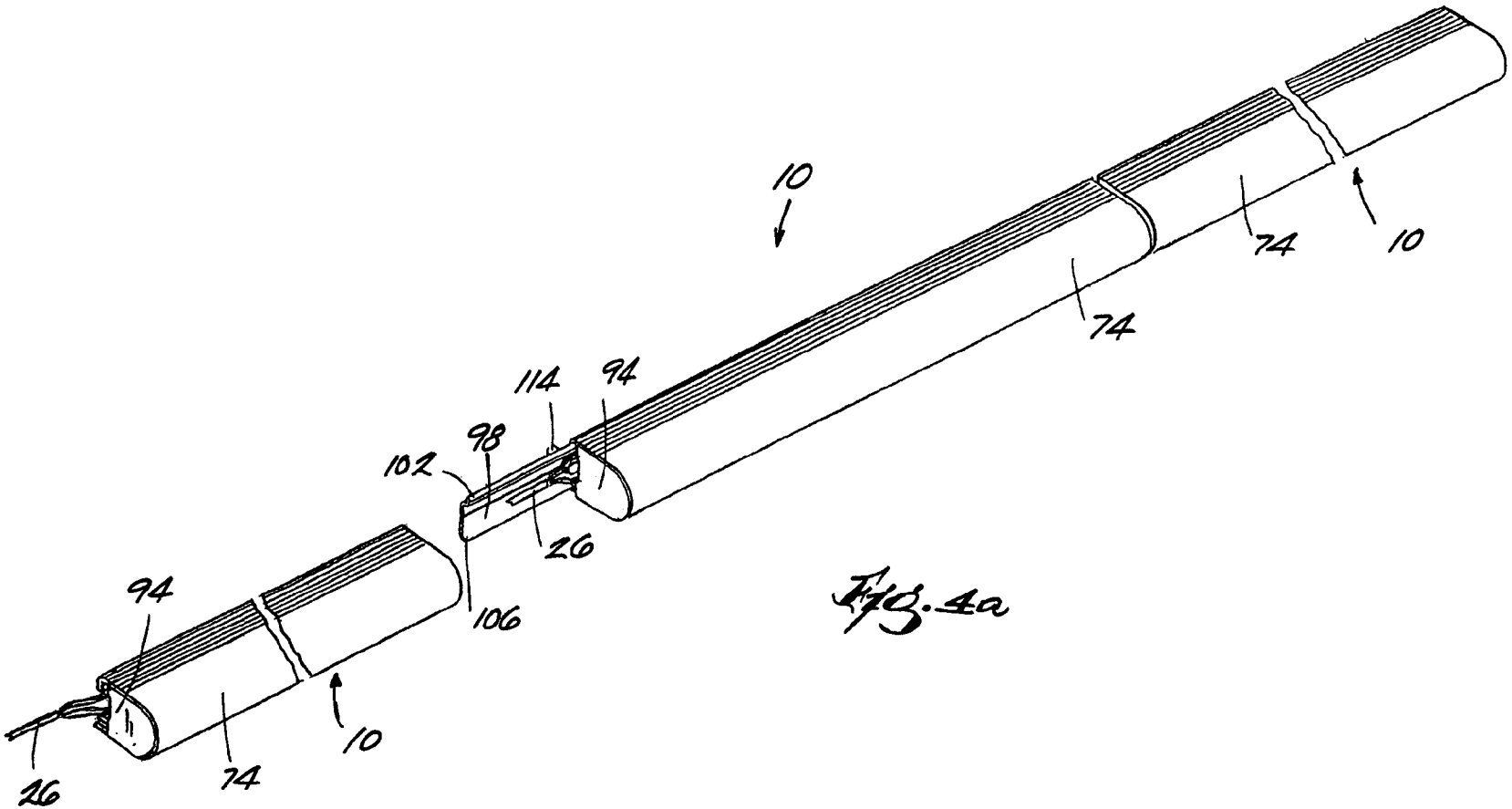
FIG. 4*a* is a perspective view of multiple LED accent lighting units of FIG. 1*a*, illustrating multiple housings connected to a mounting strip.
Figure 4B:
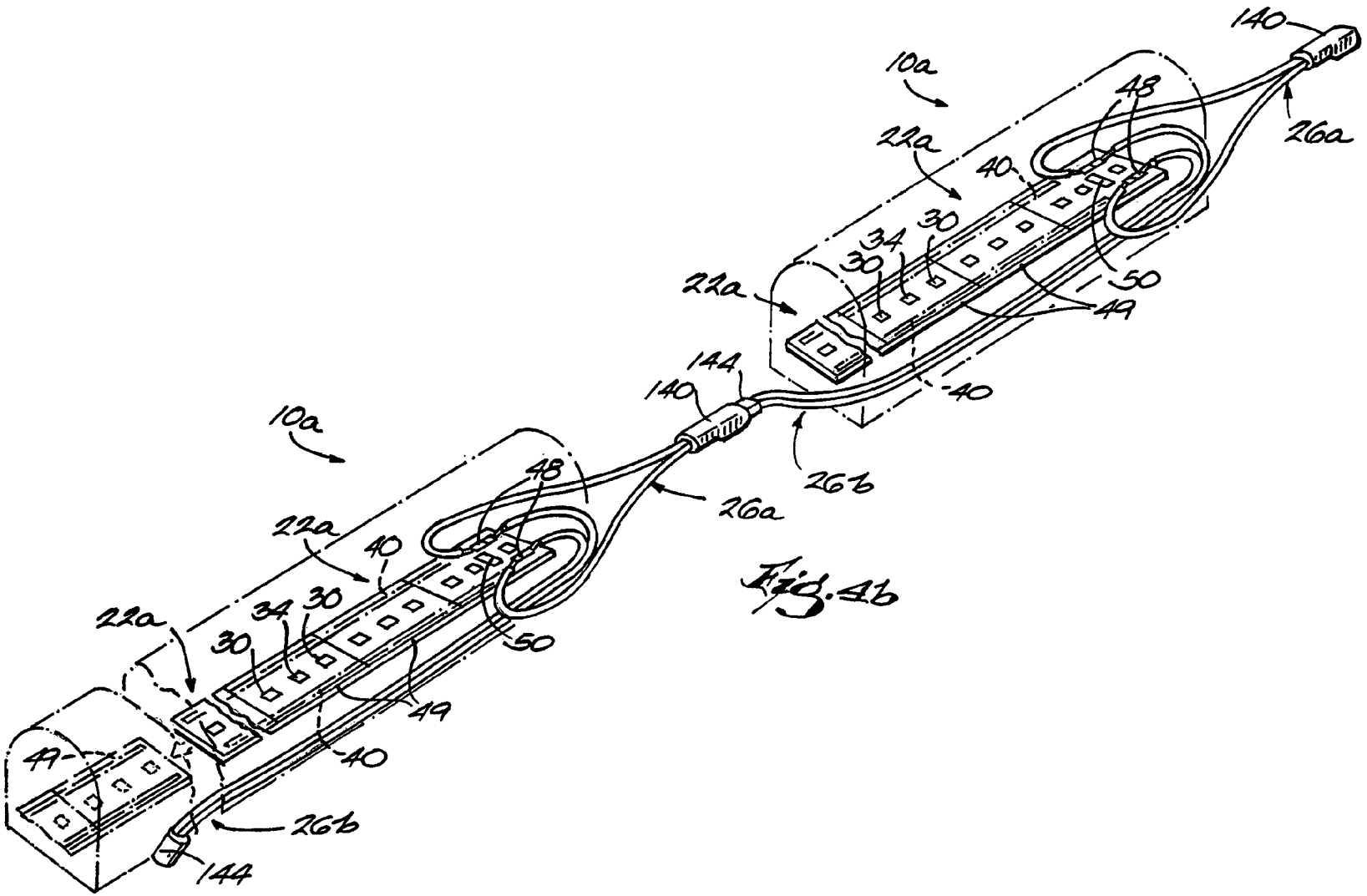
FIG. 4*b* is a perspective view of multiple, electrically connected LED accent lighting units of an alternate configuration.

As shown in FIG. 4*a*, translucent end caps 94 are coupled to the ends of the units 10. The end caps 94 substantially cover the ends of the units 10 such that light emitted from the LEDs 30 is incident on the end caps 94 as well as the lens 74. Since the end caps 94 are translucent, there are no dark spots shown on the surfaces of the lens 74 and end caps 94.

As shown in FIGS. 1*a* and 3, a mounting strip 98 is fastened to a surface where the unit 10 is to be located and includes a ball-pivoting end 102 and a first locking tab 106 to interconnect to the housing 14. The mounting strip 98 further includes a v-notch 110 disposed between the ball-pivoting end 102 and the first locking tab 106 wherein the v-notch 110 provides a guide to position the mounting strip fasteners 114 that support the unit 10. The housing 14 has a socket end 118 to receive the ball-pivoting end 102 of the mounting strip 98 and a second locking tab 122 and guide tab 126 to engage the first locking tab 106 of the mounting strip 98. To mount the housing 14 to the strip 98, the socket end 118 of the housing 14 first engages the ball-pivoting end 102 of the strip 98. The housing 14 is then pivoted such that the second locking tab 122 and guide tab 126 engage and interconnect with the first locking tab 106. As shown in FIGS. 3 and 4, the mounting strip 98 can be bolted to a surface with the ball-pivoting end 102 facing upwards. Using this configuration, the weight of the housing 14 and lens 74 is supported by the ball-pivoting end 102 of the strip 98. It should also be known that FIG. 1*a* is also a representative cross-section of the lighting unit 10*a* and substrate 22*a*.

As shown in FIG. 4*a*, several LED accent lighting units 10 may be positioned adjacent to each other to hide the individual wiring harnesses 26 attached to the individual units 10. As shown in FIGS. 1*a* and 3, a cavity 130 is formed between the housing 14 and mounting strip 98 upon their interconnection. Wiring harnesses 26 from adjacent units 10 can be disposed in the cavity 130 to keep them hidden from view. The height of the cavity 130 may be increased as needed to accommodate the wiring harnesses 26. The individual wiring harnesses 26 of the individual units 10 must then be electrically connected to the power source for operation.

As shown in FIG. 4*b*, several lighting units 10*a* utilizing the sectioned substrates 22*a* may also be positioned adjacent to each other to hide the wiring harnesses 26*a*, 26*b* attached to the individual units 10*a*. However, rather than requiring each lighting unit 10*a* to directly electrically connect to the power source, the output connector 144 of the second wiring harness 26*b* of one unit 10*a* may engage the input connector 140 of the first wiring harness 26*a* of an adjacent unit 10*a* to provide power to the adjacent unit 10*a*. Additional lighting units 10*a* may be electrically connected in the same way.

When positioned adjacent each other, the adjacent units 10, 10*a* will have the appearance of a continuous length rather than individual units 10, 10*a*. To allow for expansion and contraction of the individual units 10, 10*a* about ¼ inch gap should exist between individual units 10, 10*a*. The individual units 10, 10*a* can be manufactured between about 2 inches to typically 10 feet in length. In addition, the lighting units 10*a* utilizing the sectioned substrates 22*a* are field-cuttable such that the units 10*a* may be cut to a desired length during installation. The units 10, 10*a* also include a low profile such that they do not protrude high above the surface to which they are mounted.

In one embodiment of the present invention, the housing 14 (including the reflectors 54 and reflective surfaces 62), mounting strip 98, and lens 74 are extruded of a plastic material that is dyed to match the color of the LED 30. For example, a unit 16, 10*a* that emits green accent lighting can utilize green LEDs 30 in combination with a green housing 14 having green reflectors 54. This configuration would minimize any losses during light transmission due to the surfaces 62 of the reflectors 54 having a color of the same wavelength of the incident light. If, however, the color of the surfaces 62 of the reflectors 54 does not have a wavelength similar to the incident light, then absorption occurs at the surfaces 62 of the reflectors 54.

In another embodiment, the housing 14 is extruded of a plastic material with the reflectors 54 integrally formed within the housing 14. The mounting strip 98 is also extruded from a plastic material similar in color and substance to the housing 14. The lens 74 is extruded of a plastic material having a color of the desired accent lighting. The reflective surfaces 62 each include a white coating 134 to help maximize reflection and minimize absorption of the incident light. The coating 134 may be applied by a spinning fiber roller or by a spray nozzle. Using this configuration, white or any other color LEDs 30 can be used in combination with the colored lens 74 to achieve a desired color of accent lighting.

We claim:

1. A lighting unit, comprising:

at least one elongated substrate including a plurality of light-emitting optoelectronic devices mounted thereon;

an elongated housing supporting the elongated substrate, the housing including integrally-formed reflectors positioned adjacent the optoelectronic devices, at least one reflector positioned to reflect light emitted by at least two of the light-emitting optoelectronic devices; and a translucent output panel that transmits light from the optoelectronic devices.

2. The lighting unit of claim 1, wherein the substrate is divided into multiple sections.

3. The lighting unit of claim 2, wherein at least one section from the substrate is permanently removable from the substrate to shorten the substrate.

4. The lighting unit of claim 2, wherein at least one section includes at least two optoelectronic devices and a resistor.

5. The lighting unit of claim 1, wherein the substrate includes at least two optoelectronic devices and a resistor.

6. The lighting unit of claim 1, further comprising a transient suppressor mounted to the substrate and electrically connected with the plurality of optoelectronic devices.

7. The lighting unit of claim 1, wherein the at least one elongated substrate includes two elongated substrates, and wherein the lighting unit further comprises a connector configured for physically and electrically connecting the two substrates.

8. The lighting unit of claim 7, wherein the connector includes at least two pins electrically connecting the two substrates.

9. The lighting unit of claim 8, wherein the pins are spaced apart and are partially encapsulated by an insulating clip.

10. The lighting unit of claim 9, wherein the clip includes first and second chamfered edges.

11. The lighting unit of claim 7, wherein the connector includes at least two opposed resilient tabs configured for physically connecting the two substrates, and wherein each of the two substrates includes an aperture that receives a respective tab.

12. The lighting unit of claim 7, wherein the connector includes an insulated clip having two spaced tabs on each end thereon that are received in respective apertures in the substrates; and two spaced pins that are at least partially enclosed by the insulated clip and that electrically connect the two substrates.

13. The lighting unit of claim 1, wherein the optoelectronic devices include light-emitting diodes.

14. The lighting unit of claim 1, wherein the housing includes a slot that receives the substrate therein.

15. The lighting unit of claim 1, wherein the reflectors extend from opposing side walls of the housing.

16. The lighting unit of claim 1, wherein the reflectors are disposed on opposite sides of the optoelectronic devices, and wherein each reflector forms an acute angle with the substrate.

17. The lighting unit of claim 1, wherein at least some of the reflectors include a reflective surface that diffuses light emitted by the optoelectronic devices.

18. The lighting unit of claim 1, wherein the reflectors each include a substantially curved reflective surface.

19. The lighting unit of claim 1, wherein the reflectors each include a coated reflective surface.

20. The lighting unit of claim 19, wherein the reflective surfaces have a white colored coating.

21. A lighting unit, comprising:

at least one elongated substrate including a plurality of light-emitting optoelectronic devices mounted thereon;

an elongated housing supporting the elongated substrate, the housing including integrally-formed reflectors positioned adjacent the optoelectronic devices; and a translucent output panel that transmits light from the optoelectronic devices;

wherein the housing is molded from a plastic material, and wherein the plastic material is selected to match a color of light emitted by the optoelectronic devices.

22. A lighting unit, comprising:

at least one elongated substrate including a plurality of light-emitting optoelectronic devices mounted thereon;

an elongated housing supporting the elongated substrate, the housing including integrally-formed reflectors positioned adjacent the optoelectronic devices such that at least one reflector reflects light emitted from at least two of the light-emitting optoelectronic devices; and a translucent output panel that transmits light from the optoelectronic devices;

wherein the output panel includes a diffuser and is removably coupled to the housing.

23. The lighting unit of claim 22, wherein one of the output panel and the housing includes a hook portion and the other of the output panel and the housing includes a slot portion engageable with the hook portion to couple the output panel and the housing.

24. The lighting unit of claim 22, wherein the output panel is molded from a plastic material, and wherein the plastic material is selected to match a color of light emitted by the optoelectronic devices.

25. The lighting unit of claim 1, further comprising a mounting strip fixed to a support surface, wherein the housing is coupled to the mounting strip to secure the housing to the support surface.

26. The lighting unit of claim 25, wherein one of the mounting strip and the housing includes a ball portion, and the other of the mounting strip and the housing includes a socket portion engageable with the ball portion to couple the mounting strip and the housing.

27. The lighting unit of claim 25, wherein one of the mounting strip and the housing includes a substantially rigid tab, and the other of the mounting strip and the housing includes a resilient tab engageable with the substantially rigid tab to couple to mounting strip and the housing.

28. The lighting unit of claim 1, wherein the at least one elongated substrate includes a first substrate, the lighting unit further comprising:

a first power input for the first substrate, including an input connector, and first and second power wires each having an input end and an output end, the input ends of the first and second wires being electrically connected to the input connector and the output ends of the first and second wires being electrically connected to the first substrate; and a power output adapted to provide power to a second substrate, including third and fourth power wires each having an input end and an output end, the input ends of the third and fourth wires connected in circuit to the input connector, and the output ends of the third and fourth wires electrically connected to an output connector.

29. The lighting unit of claim 28, wherein the input connector is one of a mating male and a female connector, and wherein the output connector is the other of the male and female connector.

30. The lighting unit of claim 28, wherein the second substrate is disposed in a distinct second lighting unit.

31. The lighting unit of claim 28, wherein the input ends of the third and fourth wires are electrically connected to the output ends of the first and second wires.

32. The lighting unit of claim 28, wherein the housing includes a recess that receives the third and fourth wires.

33. A lighting unit, comprising:

a first elongated substrate including a plurality of light-emitting optoelectronic devices mounted thereon;

an elongated housing supporting the first elongated substrate, the housing including integrally-formed reflectors positioned adjacent the optoelectronic devices; and a translucent output panel that transmits light from the optoelectronic devices;

wherein the substrate includes at least two buses that electrically connect the plurality of optoelectronic devices with a power source.

34. The lighting unit of claim 33, further comprising:

a first wiring harness extending from a first end of the substrate and terminating with a first connector that is one of a male and female connector, the first wiring harness electrically connecting the plurality of optoelectronic devices with a power source; and a second wiring harness extending from a second end of the substrate and terminating with a second connector that is the other of a male and female connector.

35. A lighting unit, comprising:

at least one elongated substrate including a plurality of light-emitting optoelectronic devices mounted thereon;

an elongated housing supporting the elongated substrate, the housing including first and second side walls;

a first stem extending from the first side wall toward the second side wall, the first stem having a first reflective surface;

a second stem extending from the second side wall toward the first side wall, the second stem having a second reflective surface in substantial facing relationship with the first reflective surface, the second reflective surface being separate and distinct from the first reflective surface, the optoelectronic devices being positioned adjacent the first and second reflective surfaces; and a translucent output panel that transmits light from the optoelectronic devices.

36. The lighting unit of claim 35, wherein the first stem is integrally formed with the first side wall, and wherein the second stem is integrally formed with the second side wall.

37. The lighting unit of claim 35, wherein the optoelectronic devices include light-emitting diodes.

38. The lighting unit of claim 35, wherein the housing includes a slot that receives the substrate therein.

39. The lighting unit of claim 35, wherein the first and second reflective surfaces are disposed immediately adjacent opposite side surfaces of the optoelectronic devices, and wherein the first and second reflective surfaces form an acute angle with the substrate.

40. The lighting unit of claim 35, wherein the first and second reflective surfaces are substantially curved reflective surfaces.

41. The lighting unit of claim 35, wherein the first and second reflective surfaces are coated reflective surfaces.

42. A lighting unit, comprising:

at least one elongated substrate including a plurality of light-emitting optoelectronic devices mounted thereon;

an elongated housing supporting the elongated substrate, the housing including a bottom wall;

first and second side walls;

a first stem extending from the first side wall toward the second side wall;

a second stem extending from the second side wall toward the first side wall; and a translucent output panel that transmits light from the optoelectronic devices;

wherein the first and second side walls, the bottom wall, and the first and second stems define a slot in the elongated housing into which the at least one elongated substrate is inserted, and wherein portions of the first and second stems extend to opposite sides of the optoelectronic devices on the at least one substrate.

43. The lighting unit of claim 42, wherein the first stem is integrally formed with the first side wall, and wherein the second stem is integrally formed with the second side wall.

44. The lighting unit of claim 42, wherein the optoelectronic devices include light-emitting diodes.

45. The lighting unit of claim 42, wherein the first stem has a first reflective surface, and wherein the second stem has a second reflective surface in substantial facing relationship with the first reflective surface.

46. The lighting unit of claim 45, wherein the first and second reflective surfaces are substantially curved reflective surfaces.

47. The lighting unit of claim 45, wherein the first and second reflective surfaces are coated reflective surfaces.

48. The lighting unit of claim 45, wherein the first and second stems each include respective straight portions, and respective curved portions disposed from the straight portions.

49. The lighting unit of claim 1, wherein the at least one reflector includes first and second reflectors disposed on opposite sides of the at least two light-emitting optoelectronic devices.

50. The lighting unit of claim 22, wherein the at least one reflector includes first and second reflectors disposed on opposite sides of the at least two light-emitting optoelectronic devices.

51. The lighting unit of claim 33, wherein the integrally-formed reflectors include first and second reflectors disposed on opposite sides of at least two light-emitting optoelectronic devices.

* * * * *